United States Patent [19]

Ward

[11] Patent Number: 4,769,928

[45] Date of Patent: Sep. 13, 1988

[54] MARTIAL ARTS SHOE AND SOLE

[75] Inventor: David L. Ward, Aurora, Colo.

[73] Assignee: Shinobee Company, Inc., Aurora, Colo.

[21] Appl. No.: 88,572

[22] Filed: Aug. 24, 1987

[51] Int. Cl.[4] ..... A43B 13/14; A43B 23/04; A43B 5/00

[52] U.S. Cl. ..... 36/114; 36/590; 36/32 R; 36/51; D2/320

[58] Field of Search ..... 36/102, 103, 96, 97, 36/106, 107, 114, 7.1 R, 7.1 A, 7.6, 8.1, 59 C, 51, 50; D2/320

[56] References Cited

U.S. PATENT DOCUMENTS

| | | | |
|---|---|---|---|
| D. 127,114 | 5/1941 | Reynolds | D2/320 |
| 200,818 | 3/1878 | Bond | 36/50 |
| D. 240,281 | 6/1976 | Russell | D2/320 |
| D. 255,173 | 6/1980 | Finn | D2/320 |
| D. 257,911 | 1/1981 | Ostberg | D2/320 |
| D. 293,274 | 12/1987 | Igoe | D2/320 |
| 1,068,942 | 7/1913 | Siegel | 36/7.1 R |
| 2,216,645 | 10/1940 | Mastrandrea | 36/59 |
| 2,311,996 | 2/1943 | Parker | 36/51 |
| 3,040,454 | 6/1962 | Topper et al. | 36/51 |
| 3,389,481 | 6/1968 | England | 36/97 |
| 3,667,140 | 6/1972 | Hunderford | 36/4 |
| 3,769,722 | 11/1973 | Rhee | 36/2 R |
| 3,949,493 | 4/1976 | Rhee | 36/2 |
| 4,103,437 | 8/1978 | Dillard | 36/2 R |
| 4,190,971 | 3/1980 | Wren, Jr. et al. | 36/106 |
| 4,361,912 | 12/1982 | Arthur | 2/18 |
| 4,439,936 | 4/1984 | Clarke et al. | 36/102 |
| 4,495,715 | 1/1985 | Fredrickson et al. | 36/113 |
| 4,498,251 | 2/1985 | Shin | 36/59 C |
| 4,538,366 | 9/1985 | Norton | 36/59 C |
| 4,550,510 | 11/1985 | Stubblefield | 36/59 C |
| 4,562,651 | 1/1986 | Frederick et al. | 36/59 C |
| 4,597,199 | 7/1986 | Hong | 36/114 |
| 4,641,438 | 2/1987 | Laird et al. | 36/59 C |

*Primary Examiner*—Steven N. Meyers
*Attorney, Agent, or Firm*—John R. Kirk, Jr.

[57] ABSTRACT

A martial arts shoe and sole are provided. The shoe comprises in combination an upper with a sole, and may also include a cushion insert interposed between at least a portion thereof. The sole comprises a heel member including distal traction plates, a plurlaity of traction bars and a first plurality of cleats. The sole also comprises a front member bonded to the heel member which includes a cavity with a second plurality of cleats therein. The shoe is designed to fit snugly on the foot of the wearer, with the upper preferably constructed of a lightly padded material. The sole both provides traction and allows movement for a variety of martial arts practices, which in turn allows the shoe to be worn for normal day-to-day use.

15 Claims, 2 Drawing Sheets

FIG. 4
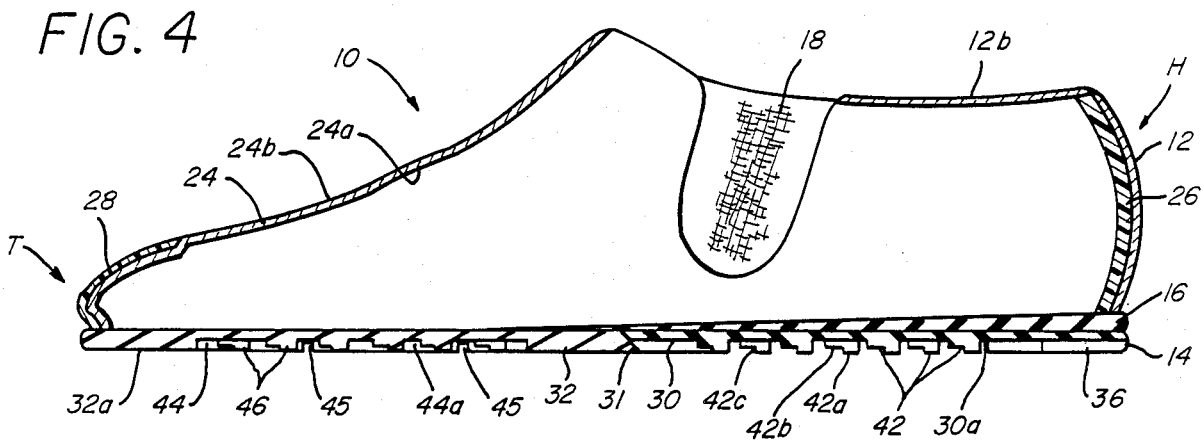
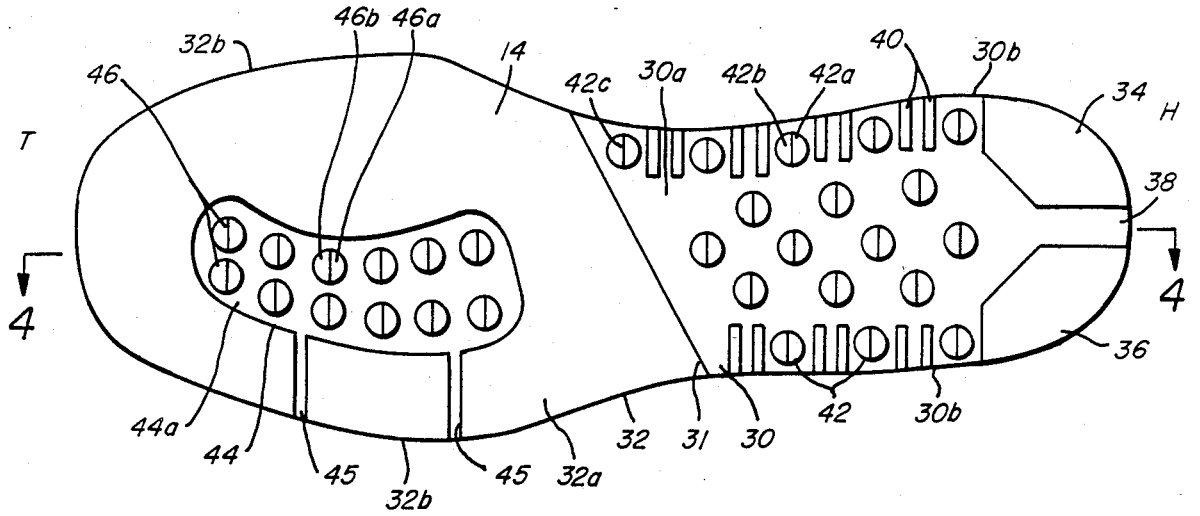
FIG. 5
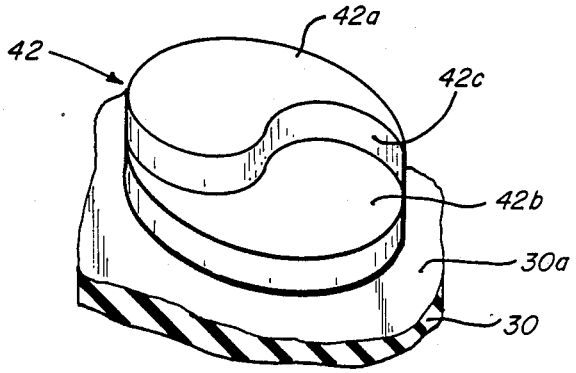
FIG. 6

MARTIAL ARTS SHOE AND SOLE

BACKGROUND OF THE INVENTION

The present invention relates generally to athletic footwear and, more particularly, to a shoe and sole designed for use in marteial art sports such as, for example, karate, judo, kick boxing and the like, as well as for normal day-to-day wear.

In the practice of the martial arts, the feet are used for a variety of purposes. In several disciplines such as karate, the feet are used for direct contact through kicking and blocking. In karate and other disciplines such as judo, foot positioning and placement are critical for leverage, support and traction.

Many marteial arts practitioners, however, do not wear protective foot coverings leaving their feet highly susceptible to injury through contact or abrasion. Also the foots by itself, may not provide adequate traction or support for the variety of spins, shifts and other movements utilized by those practitioners.

The prior art discloses a variety of foot protectors, appliances and other equipment for use in the marteial arts. For example, U.S. Pat. Nos. 3,949,493, 4,103,437 and 4,190,971 teach a unitary body, laced, open bottom foot protector which provides a protective cover for the toes, instep, ankles and back portion of the foot. U.S. Pat. Nos. 3,769,722 and 4,361,912 disclose a similar foot protector but without lacing. U.S. Pat. No. 4,495,715 discloses a toe cover to provide protection to the toes and support for the instep. U.S. Pat. No. 3,667,140 discloses a slipover shoe or boot provided with heel, toe, side, instep and shin padding. The above-listed patents are all incorporated by reference for all purposes as if fully set forth.

None of these patents, however, disclose a shoe or sole which provides the combination of protection, support and traction for the foot as well as being suitable for normal day-to-day wear.

It is, therefore, an object of the present invention to provide a martial arts shoe for protecting the feet of martial arts practitioners.

It is another object of the present invention to provide a martial arts shoe and sole for providing support and traction for the variety of movements utilized in such practice.

It is still another object of the present invention to provide a martial arts shoe and sole which may additionally be utilized for normal day to day wear.

SUMMARY OF THE INVENTION

In accordance with the present invention, there is provided such a martial arts shoe and sole. The shoe, in its overall concept, comprises in combination an upper with a specialized sole, and may also include a cushion insert interposed between the upper and sole. The upper, sole and cushion insert, i.e., the shoe of the present invention, are fashioned of a size and shaped designed to fit snugly on the foot of a wearer.

More specifically, the upper is lightly padded with a reinforced toe and heel. The upper is preferably constructed of a lightweight material such as, for example, nylon, cotton or canvas for comfort. The upper is provided with elastic inserts or Velcro® or other closures to ensure the aforementioned snug fit.

In its overall concept, the sole comprises a heel member bonded to a front member. The heel member is designed primarily for traction, and includes a first and second distal traction plate separated by a channel, a plurality of traction bars along the exterior edge of the heel member, and a first plurality of cleats both along such exterior edge and inset therefrom. The traction plates, traction bars and cleats extend out from the surface of the heel member, with the traction plates, traction bars and at least a portion of each of the cleats being substantially level with one another.

The front member is designed primarily for movement. The surface of the front member is substantially level with the traction plates of the heel member, except for a cavity inset from the exterior edge of the front member. A second plurality of cleats is provided within this cavity, with at least a portion of each of the second plurality of cleats substantially level with the surface of the front member, i.e., substantially level with the traction plates.

The martial arts shoe of the present invention provides a covering for protection of the foot of the wearer as well as a reinforced toe and heel for durability. The sole of the shoe provides traction and support to the wearer while allowing for pivoting and ease of movement when required. The martial arts shoe and sole are also adapted for normal day-to-day wear.

These and other features and advantages of the present invention will be more readily understood by those skilled in the art from a reading of the following detailed description with reference to the accompanying drawings.

BRIEF DESCRIPTION OF THE DRAWINGS

FIG. 4 is a longitudinal cross-sectional view of the martial arts shoe taken along line 4—4 of FIGS. 2 and 5.

FIG. 5 is a bottom view of the martial arts shoe showing a sole in accordance with the present invention.

FIG. 6 is a perspective top view of a second embodiment of a cleat from the sole of FIG. 5.

DETAILED DESCRIPTION OF THE PREFERRED EMBODIMENT

Figure 1:
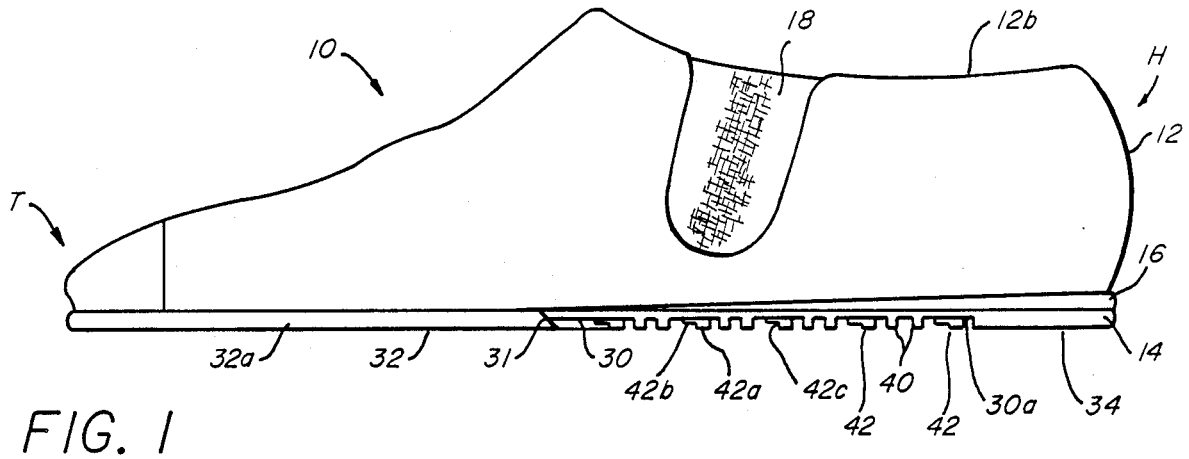
FIG. 1 is a side elevational view of a martial arts shoe in accordance with the present invention showing a first embodiment of an upper.
Figure 2:
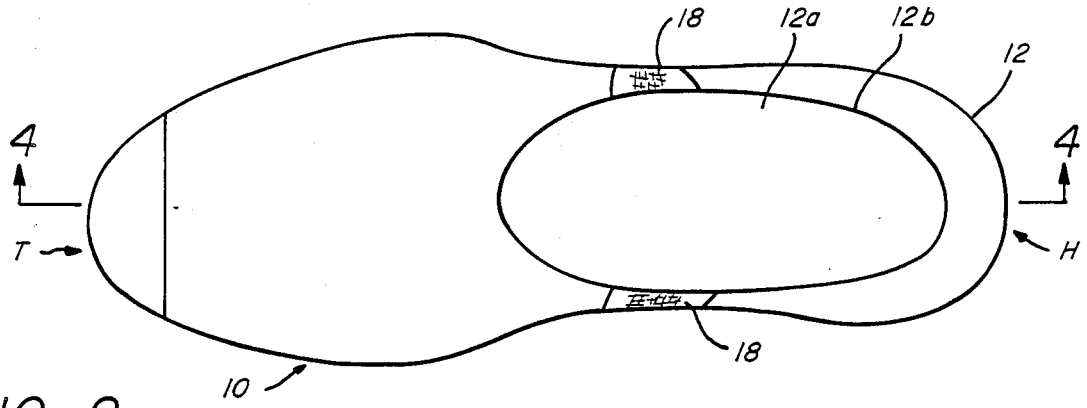
FIG. 2 is an over head elevational view of the martial arts shoe of FIG. 1.

Referring to the drawings in more detail, particularly to FIGS. 1 and 2, there is depicted a martial arts shoe 10 in accordance with the present invention. Shoe 10, in its overall concept, comprises in combination an upper 12 with a sole 14. Shoe 10 may also include a cushion insert 16 interposed between at least a portion of upper 12 and sole 14. Upper 12, sole 14 and cushion insert 16 of shoe 10 are fashioned of a size and shape adapted to snugly fit the foot of the wearer.

Upper 12 is preferably constructed of a lightweight material such as, for example, nylon, cotton or canvas. The top portion of upper 12 has an opening **12*a* defined by a rim 12*b* into which the foot of the wearer is inserted. Upper 12 is provided with an elastic insert 18 sewn or otherwise attached to the material of upper 12 along opening 12*a* and rim 12*b*** to ensure the aforementioned snug fit.

Figure 3:
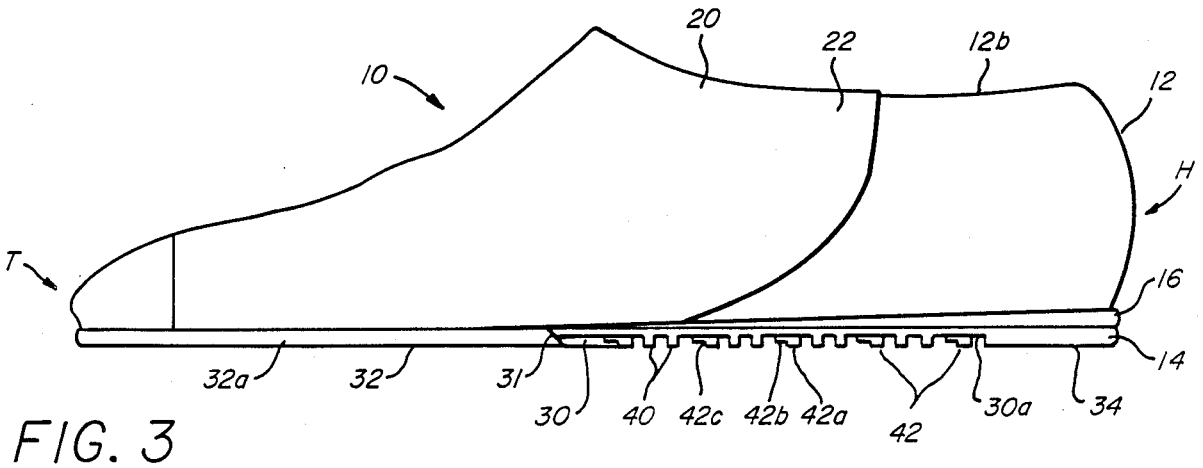
FIG. 3 is a side elevational view of the martial arts shoe showing a second embodiment of the upper.

In another embodiment of upper 12 as depicted in FIG. 3, an adjustable closure 20 is provided in place of elastic insert 18 to ensure such snug fit. Closure 20 preferably comprises a tab 22 provided with a Velcro® strip (not shown) on the underside for attachment to another Velcro® strip (also not shown) on upper 12. This arrangement allows for easy adjustment of the fit of shoe 10. Of course, closure 20 could be provided with button, snap or other well-known arrangements instead of Velcro® strips if desired, and this should not be considered a limitation on the present invention.

Referring now to FIG. 4, it can be seen that upper 12 is provided with a thin layer of light padding 24 interposed between an interior layer 24*a* and an exterior layer 24*b* of the material of construction. Padding 24 comprises a foam or other well-known cushioning material for protection of various parts of the foot from the shock of impact. Upper 12 is also provided with a reinforced heel 26 and toe 28 for endurance and long wear. Reinforced heel 26 and toe 28 comprise a stiffer and more durable material such as, for example, a leather, hard plastic or rubber insert. As depicted in FIG. 4, reinforced heel 26 is placed in the interior, and reinforced toe 28 is placed on the exterior, of upper 12. Reinforced heel 26 or toe 28, however, can be placed either on the interior or exterior of upper 12 and this should not be considered a limitation on the present invention.

Referring now primarily to FIGS. 1 and 5, sole 14 of shoe 10, in its overall concept, comprises a heel member 30 bonded to a front member 32. Heel member 30 includes first and second distal traction plates 34 and 36, respectively, spaced apart by a channel 38. Traction plates 34 and 36 extend out from the surface 30*a* of heel member 30 and are substantially level with each other.

Heel member 30 also includes a plurality of traction bars 40 along its exterior edge 30*b* forward of traction plates 34 and 36. Traction bars 40 also extend out from surface 30*a* of heel member 30 and are substantially level with traction plates 34 and 36.

Heel member 30 still further includes a first plurality of cleats 42 both along and inset from exterior edge 30*b*. Cleats 42 extend out from surface 30*a* and are preferably bi-level in construction, with the back portion 42*a* of each cleat 42 being substantially level with traction plates 34 and 36, and the front portion 42*b* slightly below such level.

As depicted in FIG. 5, each cleat 42 is generally cylindrical in shape. It should be noted that cleats 42, if desired, may be of any general frusto-geometric shape. Also as depicted in FIG. 5, the ridge 42*c* formed between back portion 42*a* and front portion 42*b* is a substantially straight line. As depicted in FIG. 6, however, ridge 42*c* need not be straight but may be S-shaped or otherwise curved. In fact, it is preferred that ridge 42*c* is S-shaped or otherwise curved to provide additional gripping surface. for cleats 42.

In the preferred embodiment, traction plates 34 and 36 are placed at the distal (heel) end H of heel member 30. Forward from traction plates 34 and 36 along exterior edge 30*b* is an alternating series of a cleat 42, a pair of spaced apart traction bars 40, another cleat 42, another pair of spaced apart traction bars 40, and so forth to the interface 31 between heel member 30 and front member 32. Cleats 42 are also inset from exterior edge 30*b* in a spaced apart pattern to ensure even coverage of the remaining portion of surface 30*a*. Additionally, all of cleats 42 preferably are oriented in the same direction, with lower front portion 42*b* oriented toward the toe end T of shoe 10 and higher back portion 42*a* oriented toward the heel end H.

The surface 32*a* of front member 32 is substantially level with traction plates 34 and 36 except for an elongated cavity 44 inset from the exterior edge 32*b* of front member 32 and one or more channels 45 extending from cavity 44 to exterior edge 32*b*. A second plurality of cleats 46 is provided within cavity 44 extending from the surface 44*a* thereof. Cleats 46 are identical in construction to cleats 42 described above, i.e., bi-level with the back portion 46*a* oriented toward heel end H and substantially level with traction plates 34 and 36, and the front portion 46*b* oriented toward toe end T and slightly below the level of back portion 46*a*.

Heel member 30 is designed primarily for traction and less for movement. Heel member 30 is preferably constructed of any one of a number of well-known hard, durable rubber, plastic or leather materials for long wearability, with traction plates 34 and 36, traction bars 40 and cleats 42 providing a sizable surface area for traction. This traction surface, however, is not so large as to overly restrict the movement of heel member 30 along a floor or other surface. The spaces between traction plates 34 and 36, traction bars 40 and cleats 42 additionally allow for channeling of water from under the shoe 10 on wet surfaces to prevent hydroplaning.

In contrast, front member 32 is primarily designed for movement and less for traction. Front member 32 is preferably constructed of any one of a number of well known soft, non-marking rubber or plastic materials which will permit sliding, spinning or other movement along a floor or other contact surface. Cleats 46, however, do provide some traction for everyday use while not substantially interfering with the aforementioned movement. Also channels 45 allow for channeling of water from under cavity 44 to prevent hydroplaning.

Referring back to FIG. 1, cushion insert 16 is depicted as being interposed between heel member 30 of sole 14 and upper 12. Cushion insert 16, if desired, may extend the length or any portion thereof interposed between upper 12 and sole 14. In the preferred embodiment, cushion insert 16 comprises a wedge-shaped foam or other well-known cushioning material interposed between heel member 30 of sole 14 and upper 12.

Upper 12, sole 14 and cushion insert 16 may be attached to one another to form shoe 10 by any means known to those skilled in the art. For example, heel member 30 and front member 32 may be glued or heat sealed to form sole 14. Cushion insert 16 may then be glued or heat sealed to the desired portion of sole 14 and upper 12 in turn glued, heat sealed, sewn, riveted or otherwise attached to sole 14 and cushion insert 16 to form shoe 10.

Of course, the ultimate size and shape of shoe 10 will be fashioned to substantially conform to the foot size and shape of the intended wearer. For those requiring additional instep, insole, arch and other related foot supports, any one of a number of well-known support devices may also be utilized.

Many other modifications and variations besides those specifically mentioned may be made in the structures described herein and depicted in the accompanying drawings without departing substantially from the concept of the present invention. Accordingly, it should be clearly understood that the form of the invention described and illustrated herein is exemplary only, and is not intended as a limitation on the scope thereof.

I claim:

1. A shoe sole for a martial arts shoe, comprising:

(a) a heel member including (i) a first distal traction plate, (ii) a second distal traction plate separated from said first traction plate by a channel, wherein said first and second traction plates extend out from a surface of said heel member and substantially level with each other.

(iii) a plurality of traction bars along an exterior edge of said heel member forward of said traction plates, wherein each of said plurality of traction bars extends out from said surface of said heel member substantially level with said first and second traction plates, and (iv) a first plurality of cleats along and inset from said exterior edge of said heel member, wherein each of said first plurality of cleats extends out from said surface of said heel member with at least a portion of each of said cleats substantially level with said first and second traction plates; and (b) a front member bonded to said heel member, wherein said front member is substantially level with said first and second traction plates, said front member including:

(i) an elongated cavity inset from an exterior edge of said front member, and (ii) a second plurality of cleats within said cavity, wherein at least a portion of each of said second plurality of cleats is substantially level with said first and second traction plates.

2. The shoe sole of claim 1, wherein each of said first plurality and second plurality of cleats is bi-level in construction.

3. The shoe sole of claim 2, wherein each of said first plurality and second plurality of cleats comprises:

a back portion oriented toward a heel end of said sole and substantially level with said traction plates;

a front portion oriented toward a toe end of said sole and slightly below the level of said back portion; and a ridge formed between said front and back portions.

4. The shoe sole of claim 3, wherein said ridge is S-shaped.

5. The shoe sole of claim 1, wherein said traction plates are placed at said heel end of said sole, with an alternating series of one of said cleats and a pair of said traction bars forward of said traction plates along said exterior edge of said heel member to an interface between said front and heel members, and with said cleats also inset from said exterior edge of said heel member in a spaced apart pattern.

6. A martial arts shoe, comprising in combination an upper with a sole, wherein said shoe is constructed of a size and shape adapted to snugly fit the foot of a wearer, and wherein said sole comprises:

(a) a heel member including (i) a first distal traction plate, (ii) a second distal traction plate separated from said first traction plate by a channel, wherein said first and second traction plates extend out from an surface of said heel member and are substantially level with each other, (iii) a plurality of traction bars along an exterior edge of said heel member forward of said traction plates, wherein each of said plurality of traction bars extends out from said surface of said heel member substantially level with said first and second traction plates, and (iv) a first plurality of cleats along and inset from said exterior edge of said heel member, wherein each of said first plurality of cleats extends out from said surface of said heel member with at least a portion of each of said cleats substantially level with said first and second traction plates; and (b) a front member bonded to said heel member, wherein said front member is substantially level with said first and second traction plates, said front member including:

(i) an elongated cavity inset from an exterior edge of said front member, and (ii) a second plurality of cleats within said cavity, wherein at least a portion of each of said second plurality of cleats is substantially level with said first and second traction plates.

7. The martial arts shoe of claim 6, wherein each of said first plurality and second plurality of cleats is bi-level in construction.

8. The martial arts shoe of claim 7, wherein each of said first plurality and second plurality of cleats comprises:

a back portion oriented toward a heel end of said sole and substantially level with said traction plates;

a front portion oriented toward a toe end of said sole and slightly below the level of said back portion; and a ridge formed between said front and back portions.

9. The martial arts shoe of claim 8, wherein said ridge is S-shaped.

10. The martial arts shoe of claim 6, wherein said traction plates are placaed at said heel end of said sole, with an alternating series of one of said cleats and a pair of said traction bars forward of said traction plates along said exterior edge of said heel member to an interface between said front and heel members, and with said cleats inset from said exterior edge of said heel member in a spaced apart pattern.

11. The martial arts shoe of claim 6, wherein said upper is constructed of a lightly padded material.

12. The martial arts shoe of claim 6, wherein said upper is provided with an elastic insert.

13. The martial arts shoe of claim 6, wherein said upper is provided with an adjustable closure.

14. The martial arts shoe of claim 13, wherein said adjustable closure comprises a tab with a Velcro ® strip on the underside of said tab for attachment to a Velcro ® strip on said upper.

15. The martial arts shoe of claim 6, further comprising a cushion insert interposed between at least a portion of said upper and said sole.

* * * * *